US005656086A

United States Patent [19]

Hultzsch et al.

[11] Patent Number: 5,656,086

[45] Date of Patent: Aug. 12, 1997

[54] COATING DEVICE FOR APPLYING THIN WET FILMS

[75] Inventors: Guenter Hultzsch, Wiesbaden; Hermann Idstein, Oestrich-Winkel, both of Germany

[73] Assignee: AGFA-Gevaert AG, Leverkusen, Germany

[21] Appl. No.: 192,750

[22] Filed: Feb. 7, 1994

[30] Foreign Application Priority Data

Feb. 5, 1993 [DE] Germany ..... 43 03 357.1

[51] Int. Cl.[6] ..... B05C 3/02

[52] U.S. Cl. ..... 118/410; 118/419

[58] Field of Search ..... 425/461, 467; 118/413, 410, 411, 419

[56] References Cited

U.S. PATENT DOCUMENTS

| | | | |
|---|---|---|---|
| 3,377,655 | 4/1968 | Kucharski | 118/466 |
| 4,029,460 | 6/1977 | Nelson | 425/466 |
| 4,143,187 | 3/1979 | Pilgrim | 118/413 |
| 4,259,379 | 3/1981 | Britton | 118/413 |
| 4,613,526 | 9/1986 | Nakamura et al. | 118/413 |
| 4,622,239 | 11/1986 | Schoenthaler et al. | 427/96 |
| 4,876,982 | 10/1989 | Claassen | 118/413 |
| 5,105,760 | 4/1992 | Takahashi et al. | 118/410 |

FOREIGN PATENT DOCUMENTS

| | | | |
|---|---|---|---|
| 4123317 | 4/1992 | Japan | 118/52 |

*Primary Examiner*—Brenda A. Lamb
*Attorney, Agent, or Firm*—Foley & Lardner

[57] ABSTRACT

A coating device for applying a thin wet film to a carrier has a slit die on which at least one flexible lip comprising a flat strip is firmly clamped. The flat strip projects beyond a leading edge of the slit die and is fixed by a clamping strip which is screwed to the inclined outside of a rigid upper lip of the slit die by means of a clamping screw. A locking pin arranged parallel to the clamping screw in the upper lip penetrates the lip and fixes it in its position together with the clamping screw, which also penetrates the flexible lip.

18 Claims, 5 Drawing Sheets

COATING DEVICE FOR APPLYING THIN WET FILMS

BACKGROUND OF THE INVENTION

The invention relates to a coating device for applying thin wet films to a carrier which is guided continuously over a support surface.

For ecological and economical reasons, development in coating technology is leading to thinner wet films at higher processing velocities. In these cases, to ensure satisfactory coating, it is necessary to place higher requirements on the freedom from disturbance of the coating process than in the case of thicker wet films.

In the case of slit-die coating, the distance of the lips from the substrate or carrier to be coated plays an important role. In general, lower wet film thicknesses or higher coating velocities require a smaller die distance, or, additionally complicated process technologies have to be used, for example in the form of a subatmospheric pressure applied to the meniscus of the wet film.

In the case of small distances, there is a high danger, as a result of particles below or on the substrate or defects in the substrate, of the slit die coming into contact therewith at high velocities and thereby of the die being damaged or the web being caused to tear. Damage to the die lip may lead to defects in the coating, so that exchange of the lips is then necessary.

To apply wet films of low thickness, according to DE-A 41 12 428 a slit die is used around which the carrier film loops. Practical difficulties arise when metal strips are to be coated since the latter, because of their high resilient restoring force, can only be guided with difficulty over the curved slit die.

In the case of this known application device of the extrusion type, the carrier film moves with a predetermined velocity and in a predetermined travel direction. The application device comprises a head which is provided with a bore running parallel to the axis of the head to receive the liquid, a slit connecting the bore to a surface of the head, a trailing-edge section which is arranged adjacent to the slit on the upstream side thereof and has a bevel whose width is less than or equal to 50 μm, but larger than the diameter of any grain of the material of the trailing-edge section, and a doctor-edge section which is arranged adjacent to the slit on the downstream side thereof with respect to the travel direction, the doctor-edge section having a bevel which has a width of approximately 2 to 3 μm and is provided on the upstream edge of the surface of the doctor-edge section.

One object of the invention is to carry out wet film coatings with slit dies at high velocities of the carrier and with low wet film thicknesses without the die lip being damaged or the web tearing as a result of defects in the wet film, in the carrier or by contact of the carrier with the slit die.

This object is achieved according to the invention in that a slit die of the coating device is equipped with at least one elastic lip comprising a flat strip which projects beyond a leading edge of the outlet orifice of the slit die.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims. The further development of the invention ensues from the features of the claims.

SUMMARY OF THE INVENTION

One essential feature of the invention consists in slit dies constructed in a conventionally rigid form being additionally equipped with resilient lips comprising flexible strips which resiliently deflect at the lips when the moving base or carrier approaches and can be simply exchanged when faults occur.

The resilient or flexible lips are mounted on the rigidly arranged upper and lower lips of slit dies. They are designed so as to be variable in geometry (angle, thickness, spacing). They may be made of plastics (polyester, polyimides, polyolefin, perfluorinated alkane, etc.), metals (steel, brass, nickel, aluminum, copper, etc.), or rubber (fluorine-containing elastomers, such as Kalrez® or Zalak® from DuPont de Nemours).

Sheets or semi-finished products of various thicknesses may be used for this purpose, for example polyester sheets with a thickness of from 50 to 400 μm. The sheets may be cut from web-shaped flat materials at right angles or at other angles, so that different geometries of the lips with respect to the substrate may be set.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENTS

Figure 1:
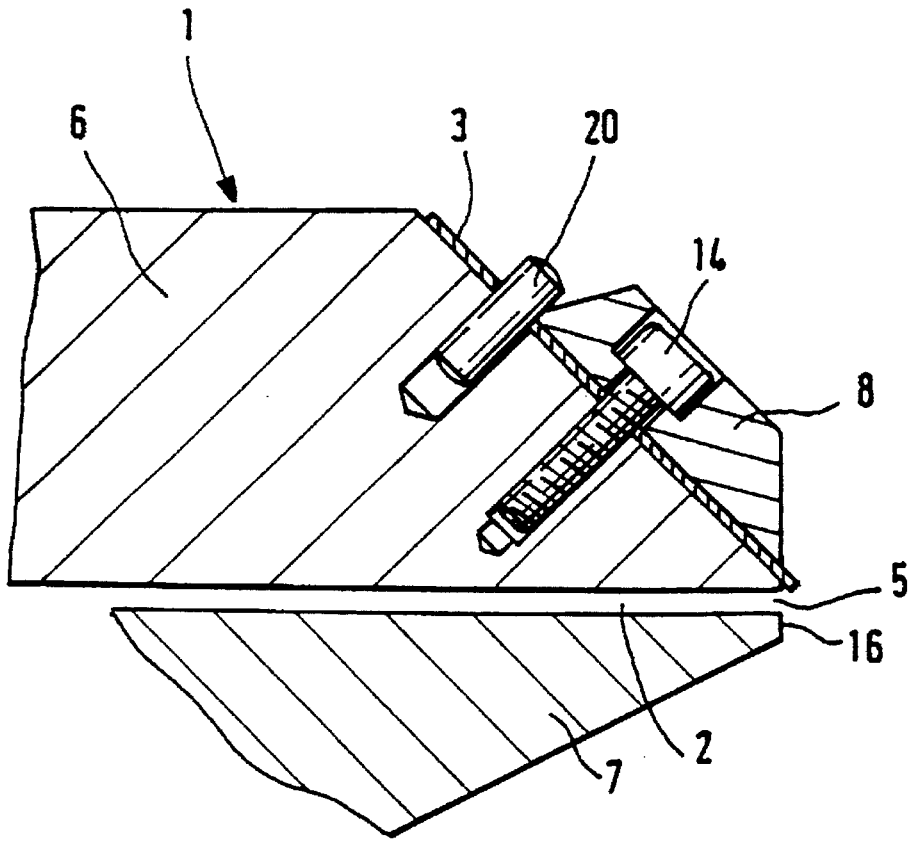
FIG. 1 shows, diagrammatically in section, a first embodiment of a slit die with a flexible lip attached thereto.
Figure 2:
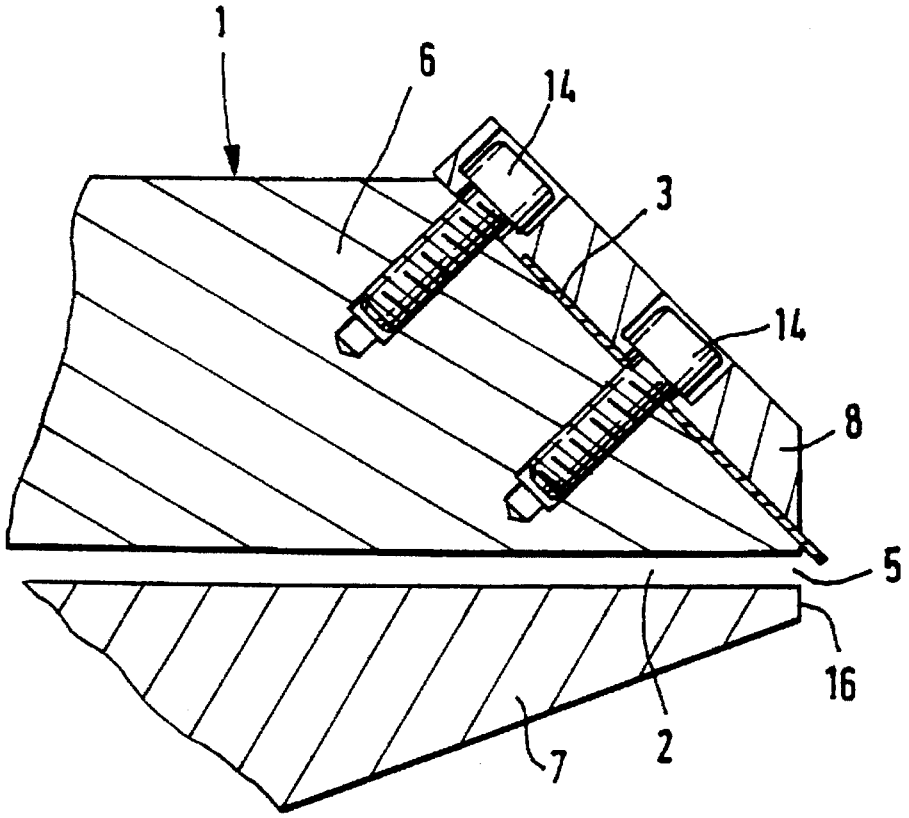
FIG. 2 shows, diagrammatically in section, a second embodiment of a slit die with a flexible lip attached thereto.
Figure 3:
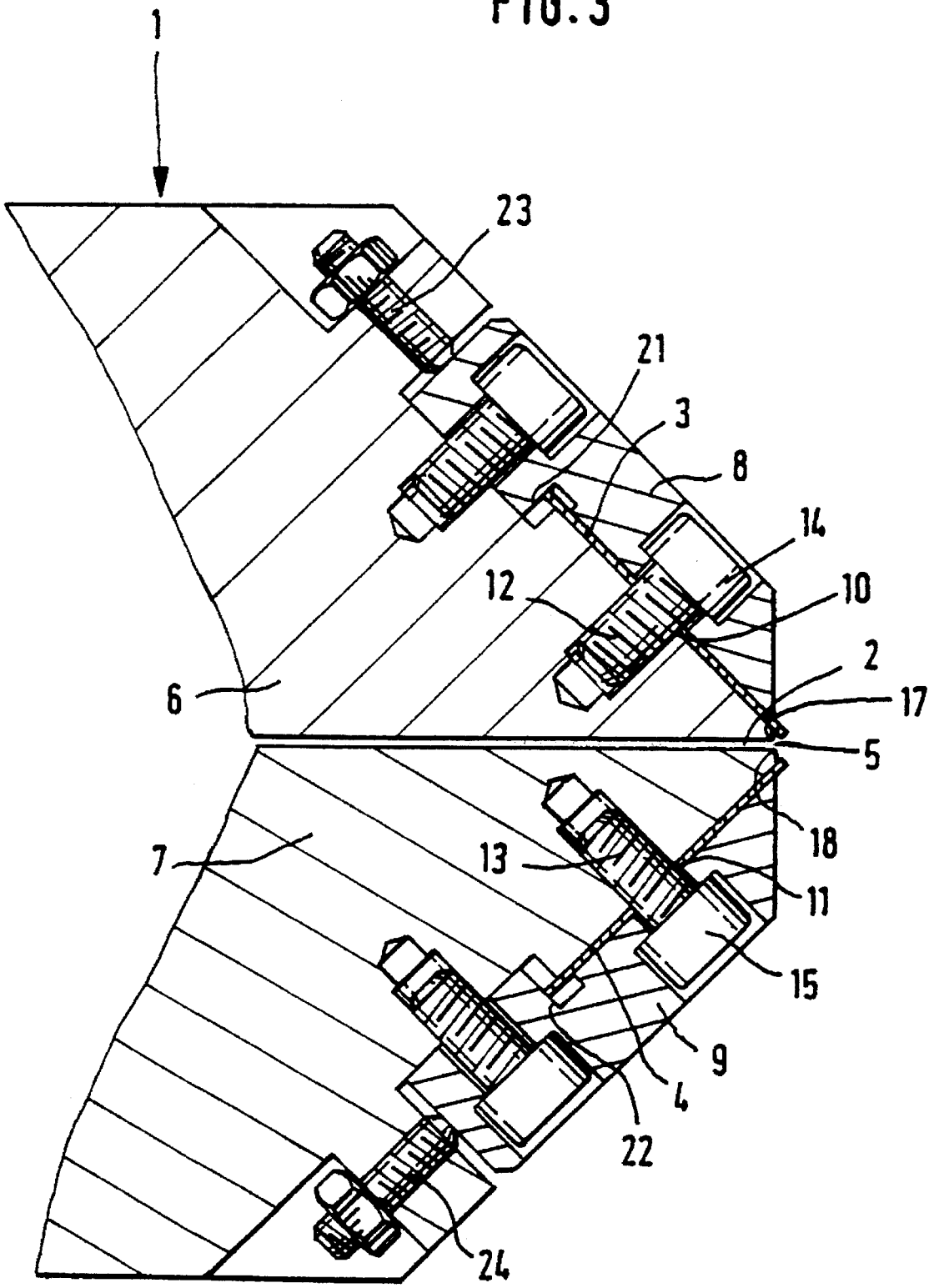
FIG. 3 shows a third embodiment of a slit die with two flexible lips in section.

In those embodiments of the coating device 1 shown in FIGS. 1 to 3, flexible lips 3 and 4 are each fixed by clamping strips 8 and 9 which are screwed to an upper lip or lower lip 6, 7 respectively of a slit die 2.

In FIG. 1, the flexible lip 3 is fixed by the clamping strip 8 which is screwed by means of a clamping screw 14 to the inclined outside of the upper lip 6 of the slit die 2. In parallel with the clamping screw 14, a locking pin 20 is arranged in the upper lip and penetrates an index hole in the lip 3 and, together with the clamping screw 14, fixes the lip 3 in position. The lip 3 projects beyond the front side 16 or beyond the outlet orifice 5 of the slit die 2.

In FIG. 1, the flexible lip 3 is fixed by the clamping strip 8 which is screwed by means of a clamping screw 14 to the inclined outside of the upper lip 6 of the slit die 2. In parallel with the clamping screw 14, a locking pin 20 is arranged in the upper lip and penetrates an index hole in the lip 3 and, together with the clamping screw 14, fixes the lip 3 in position. The lip 3 projects beyond the front side 16 or beyond the outlet orifice 5 of the slit die 2. In this embodiment, the clamping screw 14 is mounted countersunk in the clamping strip 8, whereas the locking pin 20 is located outside the clamping strip 8. In a further development of the clamping strip 8, the latter is composed of a magnetic material and is magnetically attracted and fixed by the material of the upper lip 6 of the slit die 2. The flexible lip 3 is then firmly clamped between the inclined outside of the upper lip 6 and the clamping strip 8, but without the clamping strip 8 having to be screwed to the upper lip 6. The clamping screw 14 and the locking pin 20 then each penetrate corresponding holes to the flexible lip 3, the clamping screw 14, however, being arranged outside the clamping strip 8. It goes without saying and requires no further explanation that one clamping screw 14 in each case and one locking pin 20 in each case are provided close to the narrow sides of the flexible lip 3, so that the latter is tensioned along its length by the clamping screws and the locking pins so as to be wrinkle-free.

In that embodiment of the coating device 1 shown diagrammatically in section in FIG. 2, instead of the locking pin 20 of the embodiment according to FIG. 1, a further clamping screw 14 is provided which then, just like the first clamping screw 14, penetrates the clamping strip 8 and is countersunk therein. In this embodiment, the clamping strip 8 extends beyond the flexible lip, the further clamping screw 14 not penetrating the flexible lip 3 but being arranged outside the latter. It can be seen that the flexible lip 3 of the two embodiments according to FIGS. 1 and 2 can be rapidly exchanged, since only one clamping screw and the locking pin or two clamping screws along each narrow side of the lip 3 have to be released.

In the two embodiments according to FIGS. 1 and 2, only one upper flexible lip 3 in each case is shown, although both embodiments can also be equipped with a corresponding lower flexible lip which possesses the same configuration as the upper flexible lip 3 and is attached in the same manner. Then the upper and the lower flexible lip are each arranged symmetrically to the die slit at the outsides of the upper lip and lower lip of the coating device 1. In this context, the die slit is understood to mean the gap between the upper lip 6 and the lower lip 7.

In a specific device, the fastening hole and index hole are punched dimensionally accurately in the resilient strip from which the flexible lips 3 and 4 are produced. The holes are for accurate fixing of the lips and ensure the desired position in a dimensionally accurate manner. After the lips are mounted by being pushed, accurately aligned, onto the alignment pins and a clamping strip is subsequently laid on, the lips are fastened by means of the clamping screws, another suitable clamping device, or else magnetically.

The alignment of the flexible lips 3, 4 with respect to the leading edge of the rigid die upper lip and/or die lower lip may be achieved or altered in that the clamping strips, which are provided with a stop for the elastic lip, can be adjusted in different positions by means of setting screws, as is explained with reference to FIG. 3.

In the embodiment according to FIG. 3, each of the clamping strips 8 and 9 is equipped with a stop 21 or 22 respectively for the flexible lip 3 or 4 respectively. The upper lip 6 and the lower lip 7 of the slit die 2 or of the coating device 1 are designed such that setting screws 23, 24 extend parallel to the outsides of the coating device 1 and each bear against a narrow side of the relevant clamping strip 8 or 9 respectively. By virtue of the setting screws 23, 24, the clamping strips can be displaced on the outsides of the coating device 1 and positioned. The two flexible lips 3 and 4 project by an equal distance beyond the outlet orifice 5 of the slit die 2 or beyond the leading edges 17 and 18 of the upper lip 6 and the lower lip 7 respectively. As was already mentioned above, the flexible lips 3 and 4 have dimensionally accurate holes 10 and 11 and are pushed onto alignment pins 12, 13 on the outsides of the coating device 1. Holes accurately aligned with the holes 10 and 11 in the flexible lips are present in the clamping strips 8 and 9, and, as soon as the flexible lips are pushed onto the alignment pins 12 and 13, the clamping strips 8 and 9 are also pushed onto the alignment pins and screwed to the alignment pins, which possess an internal thread, by means of clamping screws 14 and 15. The clamping device may also be designed such that the clamping strips 8 and 9 comprise a magnetic material and fix the elastic lips 3 and 4, which lie between the outsides and the clamping strips, by magnetic attraction to the outsides of the upper lip and lower lip 6 and 7 respectively. Magnetic clamping strips of this kind can be used not only in the embodiments according to FIGS. 1 to 3, but also in all embodiments according to FIGS. 4 to 11.

The use of magnetic clamping strips, but also of clamping strips joined to the outsides of the upper lip and lower lip of the coating device 1 by means of clamping screws, allows easy and rapid exchange of damaged lips 3 and 4.

The strip material for the flexible lips 3, 4 suitably comprises semi-finished products which are provided with great precision in thickness and with high resilience (springiness). Then the lips may be mass-produced from the strip material without further edge machining after punching of the index holes and fastening holes.

In addition to the springiness and the simple exchange, a further advantage consists in it being possible to vary the geometry of the flexible lips in a simple manner or adapt it to the coating conditions and in this manner to use conventional slit dies for other coating requirements. Die configurations with a flat or stepped geometry can thus be formed by longitudinal adaptation of the two lips.

Figure 4:
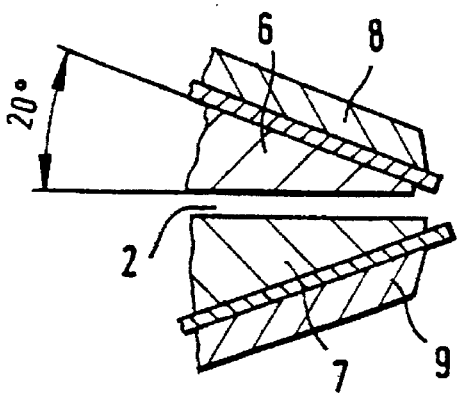
FIG. 4–11 show diagrammatically various developments of slit dies with one or two flexible lips.
Figure 5:
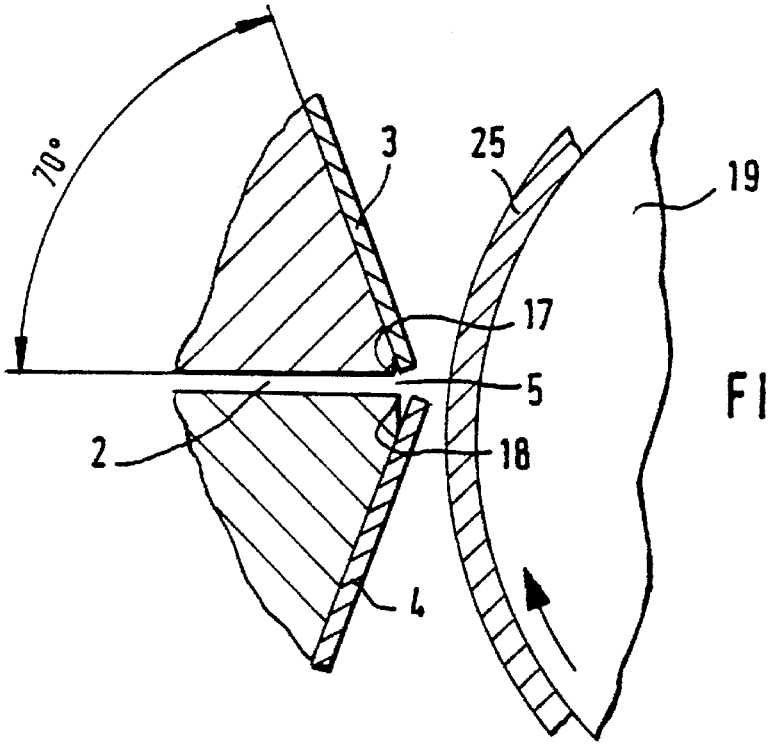
Figure 6:
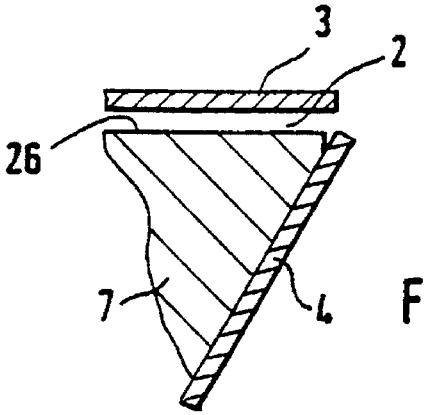
Figure 7:
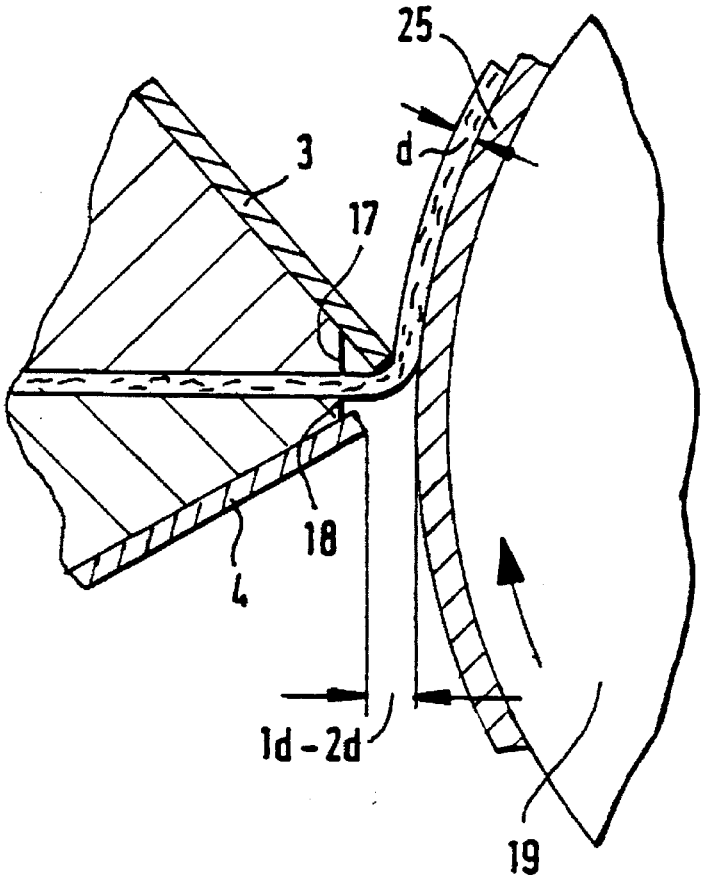

This is explained in greater detail with reference to the diagrammatically illustrated configurations of coating devices 1 in FIGS. 4 to 11. In the embodiments according to FIGS. 5 and 7, the two flexible lips 3 and 4 project to different extents beyond the leading edges 17, 18 of the outlet orifice 4. In the embodiment according to FIG. 4 an analogous situation applies, but in this case in addition, the rigid die lower lip projects further than the rigid die upper lip. In FIG. 4, clamping strips 8 and 9 are indicated diagrammatically and it is illustrated that the inclination angle of the outside of the upper lip and correspondingly also the inclination angle of the outside of the lower lip to the horizontal or to the die gap is 20°. In FIG. 5, this inclination angle between the respective outside of the upper lip or lower lip and the die gap is 70°. As a general rule, the inclined outsides of the upper lip and the lower lip of the slit die 2 may each enclose an angle with the die gap in the range between 20° and 70°.

For coatings with especially low-viscosity solutions, a stepped geometry, for example, is preferred in which the lip 3 disposed further back, seen in the web travel direction, is stepped back further by 25 to 250 μm from a film carrier 25 than the lip 4 which is leading as seen in the travel direction of the web. By virtue of the resulting low frictional pressure below the trailing lip 3, higher coating velocities are possible without sub-atmospheric pressure or smaller wet film thicknesses are possible with comparable subatmospheric pressure than when both lips have the same distance from the film carrier 25 which is guided over a counter-roll 19 (cf. FIG. 5).

In addition, in this stepped configuration it is reliably ensured that, as the carrier 25 approaches the coating die, the first lip 4, seen in the web travel direction, can flexibly yield towards the slit die 2 and in the process there is no contact at all with the second lip 3 set further back.

For medium-viscosity and high-viscosity solutions, the plane-parallel or inversely stepped arrangement of the two lips is found to be more suitable. It is decisive for the coating result in these cases that the distance of the second lip corresponds to one to two times the applied wet film thickness. This configuration, too, can be simply configured by changing the flexible lips.

For a velocity-independent mode of operation—without auxiliary processes—theoretical calculations and experimental results call for a distance which is in the region of one to two times the wet film thicknesses. To apply wet film thicknesses of approximately 30 μm, distances of 30 to 60 μm, for example, are necessary.

The exchangeable lips may be set with respect to their inclination angle to the die gap either by varying the inclination of the outsides of the coating device 1 or varied by placing wedge-shaped spacers below the flexible lip. Angles of 20° to 70° have proven themselves. However, an arrangement with a second lip 3 set parallel to the die gap (inclination 0°) is also found to give very good coating results. In this case, the second lip 3 simultaneously serves as a second die jaw. The die gap width is in this case determined by narrow web-shaped spacers, not illustrated, between a rigid leading jaw and flexible trailing jaw (cf. FIG. 6).

Furthermore, the inclination of the lip edges to the counter-roll or to the film carrier can be influenced. As a rule, the lips are cut at right angles from a flat sheet. By using suitable cutting devices, cutting angles other than 90° can also be set so as, in this manner, to improve the geometry with regard to optimum coatability.

An especially favorable lip geometry for coating processes with a tangential inclination of the two lips or of one of the two lips to the counter-roll may be achieved in a simple manner in that the lips are fixed to the coating die and the latter is moved slowly against the rotating counter-roll. If the counter-roll has been previously wound with emery cloth, or liquid abrasive bodies in the form of lapping pastes are used, an exact, tangential lip geometry can be ground in. Instead of correspondingly equipping the counter-roll with emery cloths, a suitable substrate, such as a matt, rough sheet, a roughened metal strip or a substrate coated with abrasive particles may be used for the grinding.

In the case of the arrangement of a flat substrate guide below the coating die, for example with the aid of a flat or curved counter table, the exact lip geometry may also be ground in by means of a suitable substrate.

In this manner, a precise lip geometry can be produced reproducibly in a short time without a special grinding tool.

Figure 8:
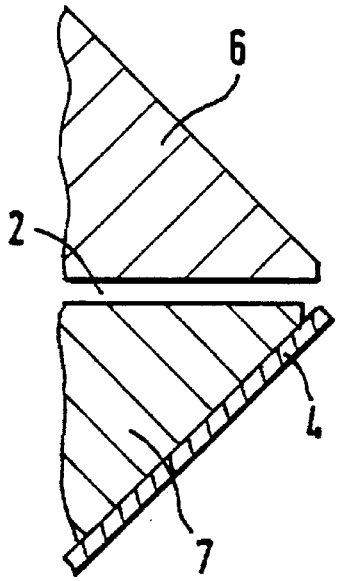

In the embodiment according to FIG. 8, the slit die 2 is only equipped with a single flexible lip 4 on the outside of the lower lip 7 of the slit die, whereas the outside of the upper lip 6 does not bear a flexible lip. It goes without saying that the reverse case may also occur, that namely the upper lip 6 has a resilient or flexible lip, whereas the lower lip 7 remains without a flexible lip. That flexible lip in each case which has the smallest distance from the film carrier to be coated is preferred. The other lip is then rigid in design as in the case of conventional coating dies and to a certain extent includes the flexible resilient lip or wear lip, i.e. in other words it has the same outline as the other rigid lip of the slit die including the flexible resilient lip or wear lip attached thereto.

Figure 9:
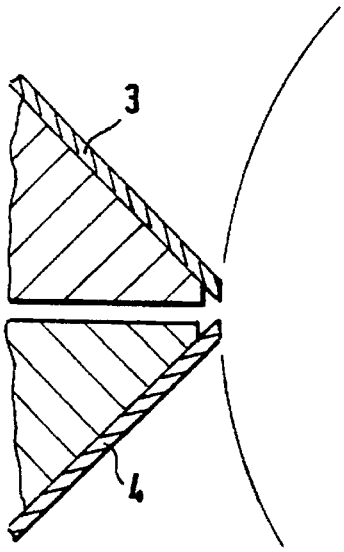
Figure 10:
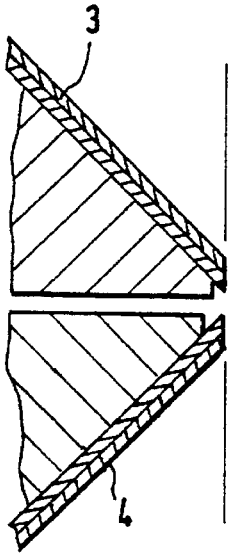

FIGS. 9 and 10 show two embodiments in which the flexible lips 3 and 4 are ground in the form of radii or flatly, corresponding to the curvature of the counter-roll or support surface 19 respectively, as has already been explained above.

Figure 11:
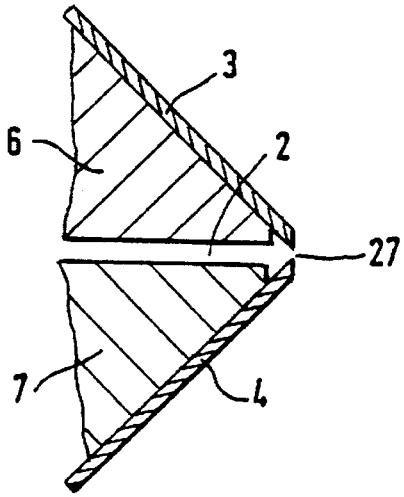

In the embodiment according to FIG. 11 of the invention, a gap 27 between the flexible lips 3 and 4 is narrower than the die gap or the orifice cross-section of the slit die 2 between the rigid upper lip and lower lip 6 and 7 respectively of the slit die 2.

The bevel width of the lips can be varied by changing the sheet thickness, for example in the range from 50 to 400 μm, in which the sheet materials possess springiness. The springiness can be increased considerably for particularly wide bevels by laying two or more sheets on top of one another.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A coating device for applying thin wet films to a carrier which is guided continuously over a support surface, comprising a slit die having an outlet orifice, a rigid upper lip, and a rigid lower lip, each rigid lip having an outside, and a leading edge which bounds the outlet orifice;

two flexible lips each including a flat strip, one of said flexible lips exchangeably attached to each outside, and the two flexible lips extending beyond the leading edges; and clamping strips, wherein each flexible lip is firmly clamped between one of the clamping strips and the outside of the upper lip or lower lip respectively, and wherein the clamping strips are composed of a magnetic material and fix the flexible lips by magnetic attraction against the outsides of the upper lip and lower lip.

2. Coating device for applying thin wet films to a carrier which is guided continuously over a support surface, comprising:

a slit die having an outlet orifice and at least one rigid lip, said at least one rigid lip including a first surface which defines a side of said outlet orifice, a second surface inclined to said first surface and enclosing an inclination angle with a die gap of the slit die in a range from 20° to 70°, and a leading edge between said first surface and said second surface which bounds said outlet orifice; and at least one flexible lip including a flat strip which projects beyond said leading edge of said outlet orifice of the slit die;

wherein said at least one flexible lip includes first and second flexible lips and said at least one rigid lip includes a lower lip, wherein the first flexible lip extends parallel to an upper edge of the lower lip of the slit die and at the same time forms an upper delimiting wall of the slit die, and wherein the second flexible lip is attached to the inclined second surface of the lower lip.

3. A coating device a coating device for applying thin wet films to a carrier which is guided continuously over a support surface, comprising:

a slit die having an outlet orifice and at least one rigid lip, said at least one rigid lip including a first surface which defines a side of said outlet orifice, a second surface inclined to said first surface and enclosing an inclination angle with a die gap of the slit die in a range from 20° to 70°, and a leading edge between said first surface and said second surface which bounds said outlet orifice; and at least one flexible lip including a flat strip which projects beyond said leading edge of said outlet orifice of the slit die;

wherein said at least one flexible lip includes two flexible lips that project beyond the leading edge;

wherein said at least one rigid lip comprises a rigid upper lip and a rigid lower lip, and the flexible lips are attached exchangeably to outsides, which comprise said second surface, of said rigid upper lip and said rigid lower lip; and wherein a gap between the flexible lips is narrower than said die gap of the slit die.

4. The coating device as claimed in claim 3, wherein each flexible lip has dimensionally accurate holes and is mounted on alignment pins on said second surfaces of said rigid upper and lower lips, and wherein the clamping strips are provided with holes and are screwed to the alignment pins by clamping screws.

5. A coating device for applying thin wet films to a carrier which is guided continuously over a support surface, comprising:

a slit die having an outlet orifice and at least one rigid lip, said at least one rigid lip including a first surface which defines a side of said outlet orifice, a second surface inclined to said first surface and enclosing an inclination angle with a die gap of the slit die in a range from 20° to 70° and a leading edge between said first surface and said second surface which bounds said outlet orifice; and at least one flexible lip including a flat strip which projects beyond said leading edge;

wherein said at least one flexible lip includes two flexible lips, and wherein the two flexible lips project to different extents beyond said leading edge.

6. The coating device as claimed in claim 5, wherein the two flexible lips comprise a material selected from the group comprising plastic, metal, and rubber.

7. The coating device as claimed in claim 6, wherein the two flexible lips are composed of polyester sheets having a thickness of 50 to 400 μm.

8. The coating device as claimed in claim 6, wherein the plastic for the two flexible lips is selected from the group comprising polyamides, polyolefins, and perfluorinated alkanes.

9. The coating device as claimed in claim 6, wherein the rubber for the two flexible lips is selected from solvent-resistent materials including fluorine-containing elastomers.

10. The coating device as claimed in claim 6, wherein the metal for the two flexible lips is selected from the group comprising steel, brass, nickel, aluminum and copper.

11. The coating device as claimed in claim 5, further comprising a carrier; wherein one of the two flexible lips disposed further back in a travel direction of the carrier is set back further by 25 to 250 μm from the carrier than the other of the flexible lips leading in the travel direction of the carrier.

12. The coating device as claimed in claim 5, further comprising a carrier; wherein the two flexible lips are spaced from the carrier by the same distance.

13. The coating device as claimed in claim 5, further comprising a carrier;

wherein one of the two flexible lips lying further back in a travel direction of the carrier is arranged closer to the carrier than the other of the two flexible lips leading in the travel direction of the carrier;

wherein the other of the two flexible lips defines a leading lip; and wherein a distance of the leading lip from the carrier is equal to one to two times a wet film thickness.

14. The coating device as claimed in claim 5, wherein at least one of said two flexible lips is fixed by a clamping strip which is screwed to said second surface of said at least one rigid lip by a clamping screw, and wherein a locking pin arranged parallel to the clamping screw penetrates the at least one-of said two flexible lips and fixes it in position.

15. The coating device as claimed in claim 5, wherein at least one of said two flexible lips is fixed by a clamping strip joined to said second surface of said at least one rigid lip by two clamping screws.

16. The coating device as claimed in claim 15, wherein the clamping strip includes a stop for the at least one flexible lip, and wherein the clamping strip is displaced and positioned on said second surface by a setting screw.

17. The coating device as claimed in claim 5, wherein said at least one rigid lip comprises a rigid upper lip and a rigid lower lip, and the flexible lips are attached exchangeably to said rigid upper lip and said rigid lower lip of the coating device.

18. The coating device as claimed in claim 5, further comprising a support surface, wherein an end of each of the two flexible lips are ground either flatly or in the form of radii, corresponding to a curvature of the support surface.

* * * * *